US006948712B1

(12) United States Patent
Lewis

(10) Patent No.: US 6,948,712 B1
(45) Date of Patent: Sep. 27, 2005

(54) CONTEST BUTTON

(75) Inventor: Edward D. Lewis, Brownsburg, IN (US)

(73) Assignee: Buztronics, Inc., Indianapolis, IN (US)

( * ) Notice: Subject to any disclaimer, the term of this patent is extended or adjusted under 35 U.S.C. 154(b) by 181 days.

(21) Appl. No.: 10/213,349

(22) Filed: Aug. 6, 2002

(51) Int. Cl.[7] ..... A63F 1/18

(52) U.S. Cl. ..... 273/139; 273/463; 463/16; 463/22; 362/104

(58) Field of Search ..... 463/1, 16, 17, 463/18, 19, 22; 273/269, 139, 138.1, 432, 273/460, 461, 138.2, 463; 362/104, 570, 362/571

(56) References Cited

U.S. PATENT DOCUMENTS

| | | | | |
|---|---|---|---|---|
| 3,104,107 | A * | 9/1963 | Powers | 273/138.2 |
| 3,791,650 | A | 2/1974 | Dice | |
| 3,805,047 | A * | 4/1974 | Dockstader | 362/104 |
| 4,141,367 | A | 2/1979 | Ferreira | |
| 4,188,779 | A | 2/1980 | Fatton | |
| 4,215,388 | A * | 7/1980 | Reimann | 362/104 |
| 4,283,052 | A | 8/1981 | Windisch | |
| 4,306,176 | A | 12/1981 | Kaneko et al. | |
| 4,516,115 | A | 5/1985 | Frigon et al. | |
| 4,541,633 | A | 9/1985 | Newbill | |
| 4,562,432 | A | 12/1985 | Sremac | |
| 4,719,544 | A * | 1/1988 | Smith | 362/104 |
| 4,910,496 | A | 3/1990 | Hatanaka et al. | |
| 5,069,453 | A | 12/1991 | Koza et al. | |
| 5,143,439 | A | 9/1992 | Lewis et al. | |
| 5,479,408 | A | 12/1995 | Will | |
| 5,683,762 | A * | 11/1997 | Banschick | 428/4 |
| 5,814,968 | A | 9/1998 | Lovegreen et al. | |
| 5,933,391 | A | 8/1999 | Uptegraph | |
| 5,992,853 | A | 11/1999 | Rudell et al. | |
| 6,273,421 | B1 | 8/2001 | Thalheimer et al. | |
| 6,331,965 | B1 | 12/2001 | Sato et al. | |
| 6,525,660 | B1 * | 2/2003 | Surintrspanont | 340/572.1 |
| 6,573,824 | B1 * | 6/2003 | Lovegreen et al. | 340/7.1 |
| 6,659,865 | B1 * | 12/2003 | Eklund | 463/17 |

OTHER PUBLICATIONS

100 Years of Magic—My Pin Box—Magic Moment Pins [online], undated [retrieved on Sep. 25, 2002]. Retrieved from the Internet: http://disney.go.com/vacations/websites/100yom/pinbox/mm_pins.html>.

FamilyFun: Celebrating 100 Years of Magic [online], c. 2001 [retrieved on Sep. 25, 2002]. Retrieved from the Internet: <http://family.go.com/travel/disney/expert/dony0701Celebration_tp/>.

* cited by examiner

*Primary Examiner*—J. Harrison
(74) *Attorney, Agent, or Firm*—William F. Bahret

(57) ABSTRACT

A multi-state flashing button and method of conducting a lottery using such a button. One or more multi-state buttons including an internal timer are distributed along with a relatively large number of single-state flashing buttons. The timer causes the multi-state buttons to change from a flashing state to non-flashing state at the end of a predetermined time-out interval, and a prize is awarded to each participant having a button which undergoes such a change of state.

7 Claims, 3 Drawing Sheets

CONTEST BUTTON

BACKGROUND OF THE INVENTION

This invention relates to games of chance, and more particularly to lotteries employing electronic devices for participants.

Lotteries conventionally employ paper tickets bearing preprinted numbers, letters and/or symbols in different combinations, one or more of which represent a winning combination. The winning ticket or tickets may be predetermined or selected in a drawing. It has also been proposed, in U.S. Pat. No. 5,069,453 to Koza et al., to provide a memory circuit in or on a lottery ticket along with an antenna, radio receiver, and comparator designed to receive a winning code, compare it with a code stored in the memory of the ticket, and, in the event of a match, provide an audio and/or visual indication that the ticket is a winning ticket. Such circuit components necessarily increase the cost and complexity of the ticket.

Moreover, there is a continuing need for innovation in lotteries as well as in other games of chance, and in particular a need for more creative ways to maintain interest among current participants and to attract more participants.

SUMMARY OF THE INVENTION

The present invention provides a new method of conducting a lottery involving distribution of electrically illuminated buttons among lottery participants, at least one of said buttons including a light circuit having more than one state including a flashing state and a non-flashing state. According to the inventive method, the state of the light circuit is changed between the flashing state and the non-flashing state in response to a predetermined condition, and a prize is awarded to a participant having an illuminated button with a light circuit which changes state between the flashing state and the non-flashing state.

Among other advantages, the invention provides a creative way to maintain interest among current game participants and to attract more participants. The advantages of the present invention will be more apparent upon reading the following detailed description in conjunction with the accompanying drawings.

DESCRIPTION OF PREFERRED EMBODIMENTS

Figure 1:
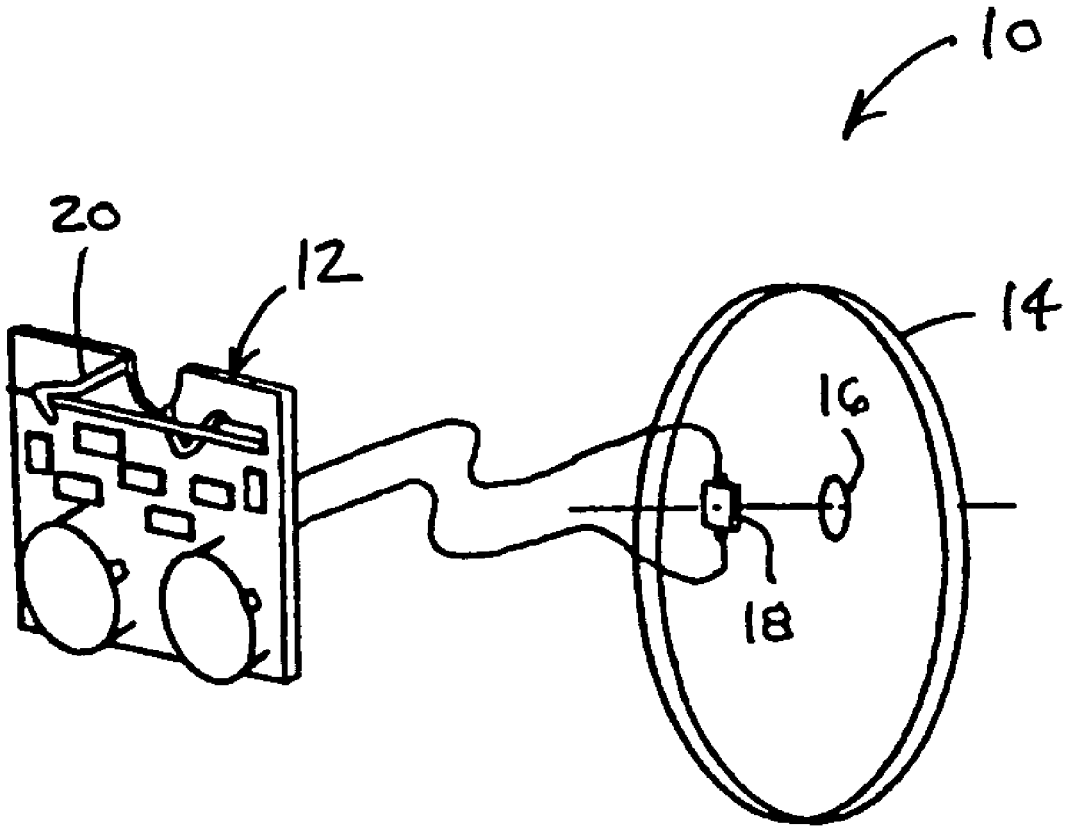
FIG. 1 is an exploded perspective view of one embodiment of a contest button according to the present invention.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further applications of the principles of the invention as illustrated therein being contemplated as would normally occur to one skilled in the art to which the invention relates.

FIG. 1 is an exploded view of one embodiment of a button 10 according to the present invention. The button includes a circuit board 12 affixed to the back surface of a plate 14 which may be provided with one or more holes 16 for LEDs such as LED 18 which may protrude partially through the plate. Transparent portions of the plate may be provided in lieu of holes. The front surface of plate 14 is preferably provided with a company logo, slogan or other indicia. The button may further be provided with a conventional pin 20 for attachment to clothing.

The LED(s) may be controlled by a flasher circuit mounted on the circuit board in a conventional manner. Two types of buttons are contemplated for use in a lottery according to the present invention, both employing the same plate type 14 and having substantially the same dimensions and outward appearance. One type has a conventional flasher circuit employing a simple oscillator to cause continual flashing of the LED(s), e.g., a type ADT705 IC available from Advanced Devices Technology, or a flasher circuit as disclosed in U.S. Pat. No. 5,143,439, assigned to the assignee of the present invention and hereby incorporated by reference. Another type of button according to the present invention is contemplated in which flashing of an LED is sustained for a predetermined time interval, after which the LED stops flashing and remains on. It is contemplated that a number of each type of button will be distributed to individuals and that those individuals wearing a button which stops flashing will be recognized as winners.

Figure 2:
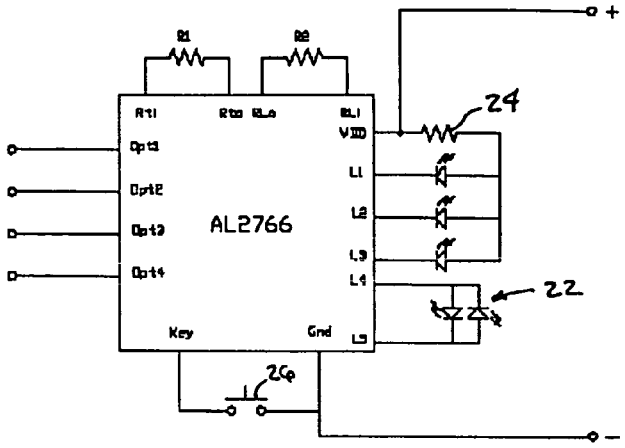
FIG. 2 is an electrical schematic of a circuit useful in a contest button according to the present invention.

One embodiment of the latter type of button has an IC timer or one-shot which is triggered by manual switch actuation. A suitable circuit for this type of button is shown in FIG. 2 and includes an AL2766 CMOS IC, available from Integroth Technology Co., Ltd., connected to three monochromatic LEDs, designated herein as L1, L2 and L3 according to the pins to which they are connected, and one bicolor LED 22. LEDs L1, L2 and L3 may be conventional clear-lens red LEDs, and the bicolor LED may, for example, be a type 3044RG-04 (3 mm red/green with clear lens) or type 3044YG-04 (3 mm yellow/green with clear lens). Clear lenses are desirable for all LEDs so that the two types of buttons match each other as much as possible except for the light effects. The circuit may also include current-limiting resistors such as resistor 24 connected to LEDs L1, L2 and L3, two timing control resistors R1 and R2 and a pushbutton membrane switch 26 connected as shown in the schematic, along with a battery source, e.g., a pair of button cells, connected to the IC as indicated in the schematic to provide a 3V DC power supply. Multiple time-out intervals or pre-set times are provided by the IC, and a desired time-out interval is selected by wire bonding of three option pins Opt1, Opt2 and Opt3 as indicated in the following table, in which a "1" indicates a high logic state, i.e., VDD (left open and pulled high internally), a "0" indicates a low logic state, i.e., ground, and an "X" indicates that the state does not matter:

| Opt3 | Opt2 | Opt1 | Pre-set Time |
|---|---|---|---|
| 0 | 0 | 0 | 2 minutes |
| 0 | 0 | 1 | 15 minutes |
| 0 | 1 | 0 | 30 minutes |
| 0 | 1 | 1 | 45 minutes |
| 1 | X | 0 | 60 minutes |
| 1 | X | 1 | 120 minutes |

The circuit also includes a duty cycle option, determined by wire bonding of option pin Opt4 of the IC, as follows:

| | |
|---|---|
| Opt4 = 0 | Duty Cycle = 1/48 |
| Opt4 = 1 | Duty Cycle = 1/6 |

The timing parameters may be adjusted by selection of the values of R1 and R2, which control the pre-set time oscillation and LED flash rate. Values of 56K and 240K, respectively, are suitable for the above-referenced timing parameters.

Figure 3:
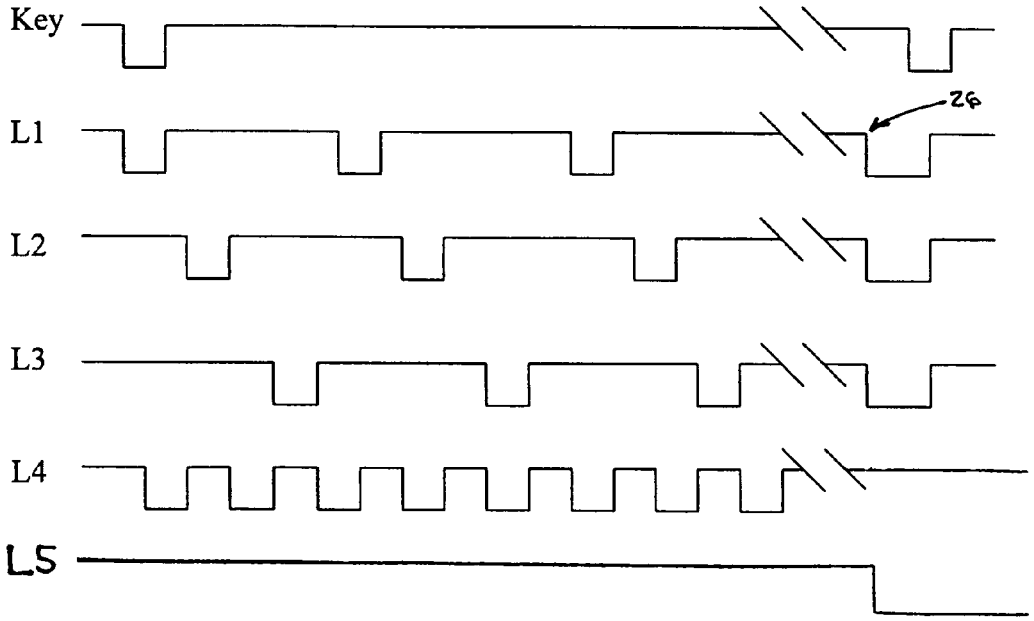
FIG. 3 is a set of timing diagrams for the circuit of FIG. 2.

Actuation of the switch causes flashing of LEDs L1, L2 and L3 in a chase sequence as indicated in FIG. 3, each LED turning on when its respective control pin goes low. Flashing in this manner continues until the timer times out, i.e., at time 26 in FIG. 3, at which time the three monochromatic LEDs stop flashing and remain on indefinitely. The bicolor LED is connected with, e.g., the cathode of a red LED element connected to L4 and the cathode of a green LED element connected to L5 such that the bicolor LED flashes red until the timer times out and then turns green indefinitely, as will be appreciated from the timing diagram of FIG. 3. When the switch is closed again, all four LEDs are turned off. The circuit is configured such that the switch must be pressed again to restart the cycle.

Figure 4:
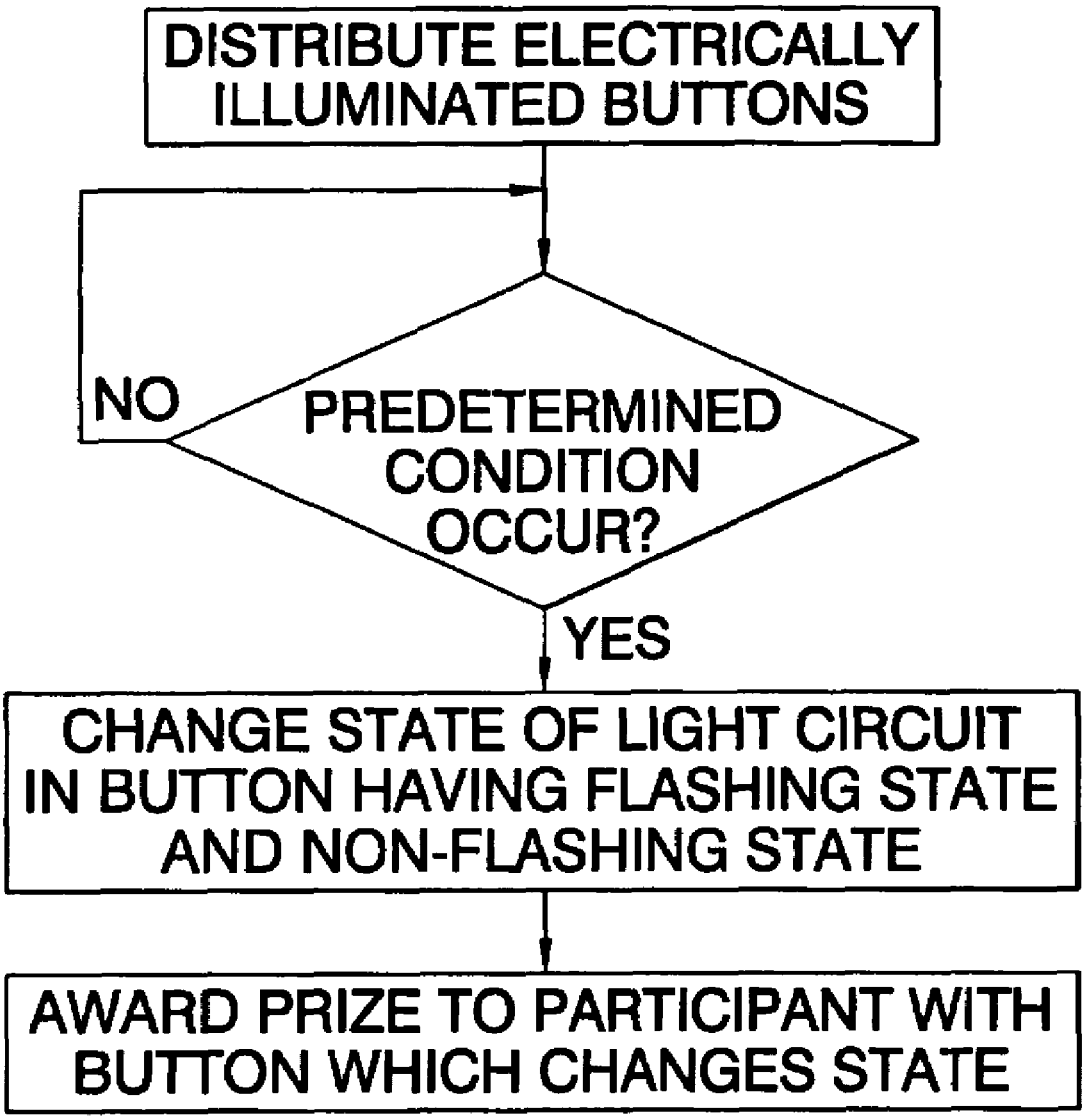
FIG. 4 is a functional flow diagram illustrating the basic steps of an embodiment of the present invention.

The functional flow diagram of FIG. 4 illustrates the basic steps of an embodiment of the claimed method, as may also be understood by reference to the claims.

While the invention has been illustrated and described in detail in the drawings and foregoing description, the same is to be considered as illustrative and not restrictive in character, it being understood that only preferred embodiments have been shown and described and that all changes and modifications that come within the spirit of the invention are desired to be protected. For example, in some applications of the invention it may be suitable to have the flashing sequence initiated after a steady on condition of an LED rather than afterward. The IC may alternatively be designed to drive only one LED via an output such as L1, or may be designed to drive only one bicolor LED via outputs such as L4 and L5, or such simplified button designs may be implemented with the IC as described above but with only selected outputs connected to an LED or LEDs.

I claim:

1. A method of conducting a lottery, comprising:

distributing electrically illuminated buttons among lottery participants, at least one of said buttons including a light circuit having more than one state including a flashing state and a non-flashing state;

changing the state of said light circuit between said flashing state and said non-flashing state in response to a predetermined condition; and awarding a prize to a participant having an illuminated button with a light circuit which changes state between said flashing state and said non-flashing state, wherein said light circuit on said button includes a timer and said change of state occurs at the end of a predetermined time-out interval of said timer.

2. The method of claim 1, wherein said light circuit switches from said flashing state to said non-flashing state at the end of said predetermined time-out interval.

3. The method of claim 2, wherein said non-flashing state is an ON state in which said light circuit energizes a light source continually.

4. The method of claim 3, wherein said light source is a multi-color LED and said light circuit causes said LED to flash in one color and then continually emit a different color of light upon said change of state.

5. A method of conducting a lottery, comprising:

distributing electrically illuminated buttons among lottery participants, at least one of said buttons including a light circuit having more than one state including a flashing state and a non-flashing state;

changing the state of said light circuit between said flashing state and said non-flashing state in response to a predetermined condition; and awarding a prize to a participant having an illuminated button with a light circuit which changes state between said flashing state and said non-flashing state, wherein said light circuit switches from said flashing state to said non-flashing state in response to said predetermined condition.

6. A method of conducting a lottery, comprising:

distributing electrically illuminated buttons among lottery participants, at least one of said buttons including a light circuit having more than one state including a flashing state and a non-flashing state;

changing the state of said light circuit between said flashing state and said non-flashing state in response to a predetermined condition; and awarding a prize to a participant having an illuminated button with a light circuit which changes state between said flashing state and said non-flashing state, wherein said non-flashing state is an ON state in which said light circuit energizes a light source continually.

7. A method of conducting a lottery, comprising:

distributing electrically illuminated buttons among lottery participants, at least one of said buttons including a light circuit having more than one state including a flashing state and a non-flashing state;

changing the state of said light circuit between said flashing state and said non-flashing state in response to a predetermined condition; and awarding a prize to a participant having an illuminated button with a light circuit which changes state between said flashing state and said non-flashing state, wherein said light circuit includes a multi-color LED and causes said LED to flash in one color and then continually emit a different color of light upon said change of state.

* * * * *